US008244149B2

(12) United States Patent
Yoshioka

(10) Patent No.: US 8,244,149 B2
(45) Date of Patent: Aug. 14, 2012

(54) IMAGE FORMING APPARATUS, IMAGE FORMING METHOD, AND COMPUTER READABLE MEDIUM FOR REDUCING GLOSS DIFFERENCE BETWEEN A FIRST IMAGE AND A REGION OF A SECOND IMAGE

(75) Inventor: Tomoaki Yoshioka, Ebina (JP)

(73) Assignee: Fuji Xerox Co., Ltd, Yokohama (JP)

( * ) Notice: Subject to any disclaimer, the term of this patent is extended or adjusted under 35 U.S.C. 154(b) by 365 days.

(21) Appl. No.: 12/608,428

(22) Filed: Oct. 29, 2009

(65) Prior Publication Data

US 2010/0329717 A1 Dec. 30, 2010

(30) Foreign Application Priority Data

Jun. 26, 2009 (JP) ..... 2009-151935

(51) Int. Cl.
*G03G 15/20* (2006.01)

(52) U.S. Cl. ..... 399/68

(58) Field of Classification Search ..... 399/68, 399/69, 401
See application file for complete search history.

(56) References Cited

U.S. PATENT DOCUMENTS

2002/0064404 A1 5/2002 Iwai
2007/0140716 A1 6/2007 Tanaka
2007/0280759 A1* 12/2007 Isemura et al. ..... 399/341
2009/0034998 A1* 2/2009 Omata ..... 399/45

FOREIGN PATENT DOCUMENTS

JP 11-272116 A 10/1999
JP 2001183925 A 7/2001
JP 2002-318482 A 10/2002
JP 2003-076208 A 3/2003
JP 2005055517 A 3/2005
JP 2008139589 A 6/2008

OTHER PUBLICATIONS

Extended European search report dated Oct. 8, 2010, issued by the European Patent Office in counterpart European Application No. 10156175.1.

* cited by examiner

*Primary Examiner* — Quana M Grainger
(74) *Attorney, Agent, or Firm* — Sughrue Mion, PLLC

(57) ABSTRACT

An image forming apparatus includes: a gloss difference reducing unit that reduces a difference between gloss of first image that is formed without using transparent toner in a first mode and gloss of a region, which does not use transparent toner, of a second image that is formed using transparent toner on part of an image in a second mode, the first mode being set for forming the first image onto a medium in one fixing operation, and a second mode being set for forming the second image by implementing a second fixing step that fixes transparent toner to part of an intermediate image, after a first fixing step that fixes the intermediate image that has been formed by toner other than transparent toner on the medium.

16 Claims, 3 Drawing Sheets

IMAGE FORMING APPARATUS, IMAGE FORMING METHOD, AND COMPUTER READABLE MEDIUM FOR REDUCING GLOSS DIFFERENCE BETWEEN A FIRST IMAGE AND A REGION OF A SECOND IMAGE

CROSS-REFERENCE TO RELATED APPLICATIONS

This application is based on and claims priority under 35 USC 119 from Japanese Patent Application No. 2009-151935 filed Jun. 26, 2009.

BACKGROUND

Technical Field

The present invention relates to an image forming apparatus, an image forming method, and a computer readable medium.

SUMMARY

According to an aspect of the invention, there is provided an image forming apparatus including: a gloss difference reducing unit that reduces a difference between gloss of an first image that is formed without using transparent toner in a first mode and gloss of a region, which does not use transparent toner, of a second image that is formed using transparent toner on part of an image in a second mode, the first mode being set for forming the first image onto a medium in one fixing operation, and a second mode being set for forming the second image by implementing a second fixing step that fixes transparent toner to part of an intermediate image, after a first fixing step that fixes the intermediate image that has been formed by toner other than transparent toner on the medium.

BRIEF DESCRIPTION OF THE DRAWINGS

An exemplary embodiment of the present invention will be described in detail below with reference to the drawings, wherein.

DETAILED DESCRIPTION

Exemplary embodiments of the present invention will be described below.

Figure 1:
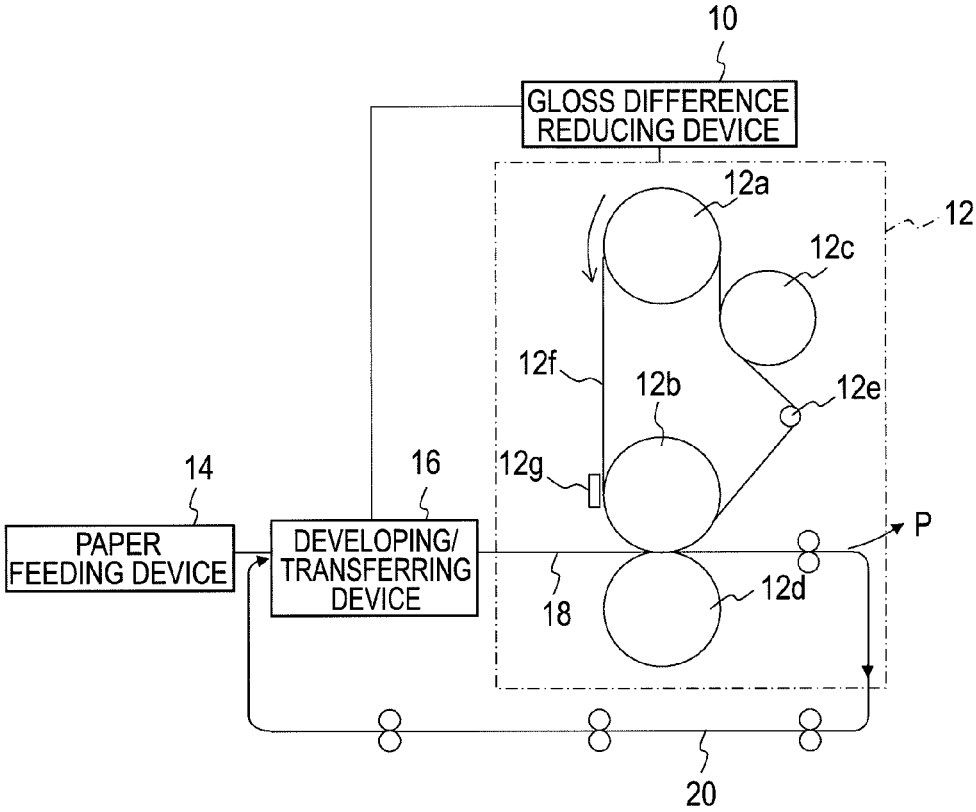
FIG. 1 is a diagram showing a configural example of an image forming apparatus.

In FIG. 1, there is shown a configural example of an image forming apparatus. In FIG. 1, the image forming apparatus is configured to include a gloss difference reducing device 10, a fixing device 12, a paper feeding device 14, a developing/transferring device 16, a medium conveying path 18 and a medium circulating path 20.

The gloss difference reducing device 10 controls the toner image fixing operation of the fixing device 12 to reduce the difference between gloss of an image that is formed without using transparent toner and gloss of a region, which does not use transparent toner, of an image that is formed using transparent toner on part of an image region. Specific examples of the method of controlling the toner image fixing operation will be discussed later.

The fixing device 12 is configured to include heat rollers 12*a*, 12*b* and 12*c*, a pressure roller 12*d*, a tension roller 12*e*, a fixing belt 12*f* and a temperature measuring instrument 12*g*. The fixing device 12 performs fixing processing by heating and pressurizing a medium such as printing paper to which a toner image has been transferred and which has been received from the developing/transferring device 16. Because of this fixing processing, an image that is formed without using transparent toner and an image that is formed using transparent toner on part of an image are fixed on the medium such that a toner image is formed.

Here, unillustrated heating units (halogen lamps or the like can be used) are disposed inside the heat rollers 12*a*, 12*b* and 12*c*, and the heat rollers 12*a*, 12*b* and 12*c* heat the fixing belt 12*f* on the basis of the control of the gloss difference reducing device 10. Further, the pressure roller 12*d* sandwiches, between itself and the heat roller 12*b*, the fixing belt 12*f* and the medium that is conveyed by the medium conveying path 18, and the pressure roller 12*d* applies pressure for fixing to the medium. At this time, a temperature for fixing is also applied to the medium from the fixing belt 12*f*. Further, the tension roller 12*e* causes a predetermined tension to act on the fixing belt 12*f*. Further, the fixing belt 12*f* is wound with a predetermined tension around the heat rollers 12*a*, 12*b* and 12*c* and the tension roller 12*e* and is driven to circulate at a moving velocity equal to the circumferential velocity of the pressure roller 12*d* along the direction of the arrow by the heat roller 12*b* that is driven to rotate by an unillustrated drive motor. It will be noted that the moving velocity of the fixing belt 12*f* is controlled by the gloss difference reducing device 10 in order to control the moving velocity of the medium. The temperature measuring instrument 12*g* measures the temperature of the fixing belt 12*f* and outputs the measurement result to the gloss difference reducing device 10. The gloss difference reducing device 10 controls the temperatures of the heat rollers 12*a*, 12*b* and 12*c* on the basis of the measurement output of the temperature measuring instrument 12*g* to control the fixing temperature of the medium. It will be noted that the fixing device 12 may also have a configuration that does not use the fixing belt 12*f*. In this case, the fixing device 12 performs heating and pressurization by sandwiching, between the heat roller 12*b* and the pressure roller 12*d*, the medium that is conveyed by the medium conveying path 18.

The paper feeding device 14 holds the medium such as printing paper and supplies the medium to the developing/transferring device 16. It will be noted that the paper feeding device 14 may also be given a configuration that can hold several types of the medium.

The developing/transferring device 16 forms an electrostatic latent image on the surface of an unillustrated photoconductor drum with a laser beam emitted in accordance with image data that are the target of image formation and develops this electrostatic latent image as a toner image of each color of yellow, magenta, cyan, black and transparent. The developing/transferring device 16 transfers the developed toner image to the medium. The medium to which the toner image has been transferred is conveyed to the fixing device 12 by the medium conveying path 18. It will be noted that the developing/transferring device 16 may also be given a configuration that develops and transfers only a black-and-white image using black toner or black and transparent toners. Further, for the acquisition of the image data, there are a configuration that acquires the image data with an appropriate communication unit from an image creating device such as a computer and a configuration that acquires the image data with an image reading device such as a scanner, but the acquisition of the image data is not limited to these. The developing/transferring device 16 analyzes the acquired image data and determines the region on the image that is to use the toners of each color and the type and use amount of the toners to be used. The gloss difference reducing device 10 is also notified of information relating to the result of analysis of the image data (particularly whether or not to use transparent toner). The developing/transferring device 16 may also be given a configuration that determines the use region and the use amount of transparent toner on the basis of instruction information that a user has inputted.

The medium conveying path 18 is configured to include appropriate conveyance-use rollers and a belt and conveys the medium to which the toner image has been transferred to the fixing device 12 from the developing/transferring device 16. Further, fixing processing is performed by the fixing device 12, and the medium conveying path 18 discharges, in the direction of arrow P, the medium on which the toner image has been formed.

The medium circulating path 20 is configured to include appropriate conveyance-use rollers and a belt and is a path for returning the medium after fixing processing to the developing/transferring device 16 from the fixing device 12. That is, when forming the image that is formed using transparent toner on part of an image, after a first fixing step where the fixing device fixes the medium to which an intermediate image that has been formed by yellow, magenta, cyan and black toners (i.e., toners other than transparent toner) has been transferred, the medium circulating path 20 again supplies the medium to the developing/transferring device 16, and the developing/transferring device 16 transfers transparent toner to part of the image region that has been fixed in the first fixing step. The medium to which the transparent toner has been transferred is again conveyed to the fixing device 12 by the medium conveying path 18, a second fixing step is performed, and the transparent toner is fixed.

Usually, the gloss of toner after fixing processing is determined by the surface state (surface roughness) of the toner, and the surface state of the toner can be controlled by the heating amount during fixing processing. For this reason, the gloss difference reducing device 10 controls the amount of heat that is applied to the toner during fixing processing by controlling the temperature of the fixing belt 12*f* or the moving velocity of the medium sandwiched between the fixing belt 12*f* and the pressure roller 12*d* to thereby reduce the difference between the gloss of the image that is formed without using transparent toner and the gloss of the region, which does not use transparent toner, of the image that is formed using transparent toner on part of an image.

For example, the image that is formed without using transparent toner on the medium is fixed in one fixing operation by the fixing device 12 after toner has been transferred onto the medium. On the other hand, the image that is formed using transparent toner on part of the image region on the medium is formed by a first fixing step performed by the fixing device 12 after yellow, magenta, cyan and black toners have been transferred, without using transparent toner, to form an intermediate image and by a second fixing step performed by the fixing device 12 after transparent toner has been transferred to part of the toner image that has been formed in the first fixing step. For this reason, the region, which does not use transparent toner, of the image that is formed using transparent toner on part of an image is heated two times in the first fixing step and the second fixing step, and it is easy for the heating amount to become larger than that of the image that is formed without using transparent toner. Thus, the gloss difference reducing device 10 sets the fixing temperature in the first fixing step lower than the fixing temperature during the fixing of the image that is formed without using transparent toner to control the heating amount of the region, which does not use transparent toner, of the image that is formed using transparent toner on part of an image until the end of the second fixing step. The fixing temperature can be controlled by the temperature of the fixing belt 12*f*. How much lower the gloss difference reducing device 10 sets the fixing temperature in the first fixing step than the fixing temperature of the image that is formed without using transparent toner is decided beforehand by the properties of the toner to be used and the surface state of the medium.

It will be noted that the fixing temperature in the second fixing step has as an upper limit the temperature at which the gloss of the region, which does not use transparent toner, of the image that is formed using transparent toner on part of an image after the second fixing step becomes equal to the gloss of the image that is formed without using transparent toner when the fixing temperature in the first fixing step is used as the lowest fixing temperature of the toner (lowest temperature that can fix the toner to the medium). This is because, when the fixing temperature in the second fixing step is raised beyond this upper limit, the gloss of the region, which does not use transparent toner of the image that is formed using transparent toner on part of an image becomes too high and the gloss difference reducing device 10 becomes unable to reduce the difference with the gloss of the image that is formed without using transparent toner.

Or, the gloss difference reducing device 10 may also set the moving velocity of the medium in the first fixing step faster than the moving velocity of the medium during fixing of the image that is formed without using transparent toner. Here, the moving velocity of the medium is controlled by the velocity of the fixing belt 12*f*. The faster that the moving velocity of the medium becomes, the shorter that the sojourn time in the heating region sandwiched between the heat roller 12*b* and the pressure roller 12*d* becomes and the smaller that the heating amount during fixing processing becomes. How much faster the gloss difference reducing device 10 makes the moving velocity in the first fixing step than the moving velocity of the image that is formed without using transparent toner is decided beforehand by the properties of the toner to be used and the surface state of the medium.

Figure 2A:
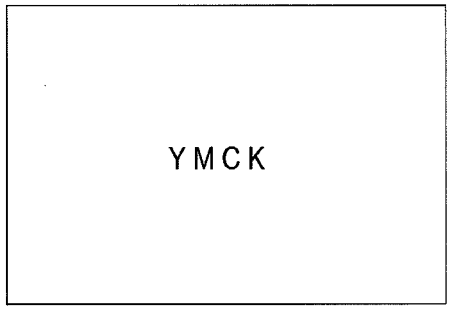
FIG. 2A and FIG. 2B are diagrams showing examples of an image that is formed without using transparent toner and an image that is formed using transparent toner on part of an image.
Figure 2B:
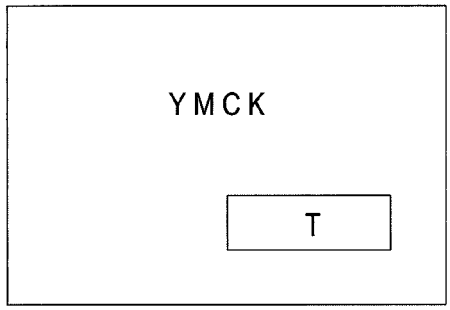

In FIG. 2A and FIG. 2B, there are shown examples of the image that is formed without using transparent toner and the image that is formed using transparent toner on part of an image. FIG. 2A is an example of the image that is formed without using transparent toner, and the image is formed, for example, by yellow (Y), magenta (M), cyan (C) and black (K) toners. Further, FIG. 2B is an example of the image that is formed using transparent toner on part of an image, and an image region that has been formed by transparent toner (T) exists in part of the image region that has been formed, for example, by yellow (Y), magenta (M), cyan (C) and black (K) toners.

Figure 3A:
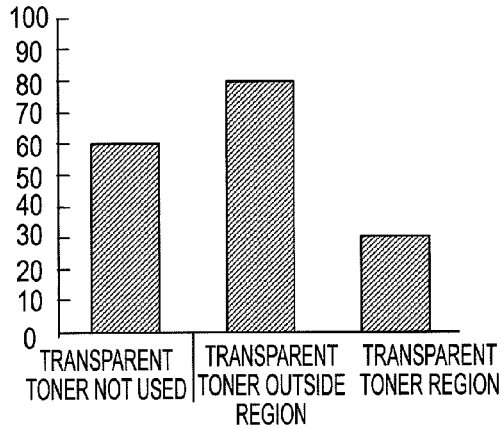
FIG. 3A and FIG. 3B are diagrams showing examples of results of controlling gloss of the image that is formed without using transparent toner and gloss of the image that is formed using transparent toner on part of an image.
Figure 3B:
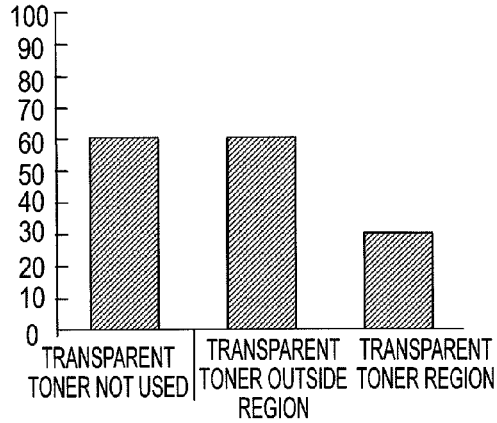

In FIG. 3A and FIG. 3B, there are shown examples of results of controlling the gloss of the image that is formed without using transparent toner and the gloss of the image that is formed using transparent toner on part of an image. In FIG. 3A and FIG. 3B, the vertical axis represents measured values of the gloss of the toner images and the horizontal axis represents the type of the toner images. For measurement of the gloss, there is, for example, a method that irradiates a measurement target toner image with light at an incident angle of 60 degrees, measures the reflected light in the direction of a reflection angle of 60 degrees, and uses the ratio between the amount of incident light and the amount of reflected light as the gloss.

FIG. 3A shows the gloss in a case where fixing is performed by one fixing operation at 150° C. with respect to a color image where YMC are superposed, which is the image that is formed without using transparent toner (written as "Transparent Toner Not Used"), and also shows the gloss of the region that does not use transparent toner (written as "Transparent Toner Outside Region") and the gloss of the region that uses transparent toner on part of an image toner (written as "Transparent Toner Region") in a case where the first fixing step is implemented at 150° C. with respect to a color image where YMC are superposed to form an intermediate image and thereafter transparent toner is applied to part of the intermediate image and the second fixing step is implemented at 130° C. to form the image that is formed using transparent toner on part of an image.

Further, FIG. 3B shows the gloss of the image, which is formed without using transparent toner, of FIG. 3A (written as "Transparent Toner Not Used") and also shows the gloss of the region that does not use transparent toner (written as "Transparent Toner Outside Region") and the gloss of the region that uses transparent toner (written as "Transparent Toner Region") in a case where the first fixing step is implemented at 140° C. and thereafter the second fixing step is implemented at 130° C. to form the image that is formed using transparent toner on part of an image.

In the example in FIG. 3A, the gloss difference reducing device 10 controls the fixing temperatures so as to make the gloss of the transparent toner region of the image that is formed using transparent toner on part of an image lower than the gloss of the transparent toner outside region. That is, the gloss difference reducing device 10 sets a fixing temperature T2 in the second fixing step lower than a fixing temperature T1 in the first fixing step during formation of the image that is formed using transparent toner on part of an image. Further, the fixing temperature T1 in the first fixing step is set to be the same temperature as a fixing temperature T0 of the image that is formed without using transparent toner. In this case, as for the image that is formed using transparent toner on part of an image, heating and pressurization are performed two times on the toners other than the transparent toner because fixing processing is performed in the first fixing step and the second fixing step. For this reason, the surface state of the toners in the transparent toner outside region of the image that is formed using transparent toner on part of an image is excessively smoothed and, as shown in FIG. 3A, the gloss of the transparent toner outside region becomes higher than the gloss of the image that is formed without using transparent toner.

Thus, when the gloss difference reducing device 10 sets the fixing temperature T1 in the first fixing step lower than the fixing temperature T0 of the image that is formed without using transparent toner (T1<T0), a situation where the surface state of the toner in the transparent toner outside region of the image that is formed using transparent toner on part of an image is excessively smoothed is controlled. As a result, as shown in FIG. 3B, the gloss difference reducing device 10 can reduce the difference between the gloss of the transparent toner outside region and the gloss of the image that is formed without using transparent toner (so that the gloss of these becomes substantially the same).

It will be noted that, in the examples in FIG. 3A and FIG. 3B, the gloss difference reducing device 10 controls the gloss with the fixing temperature, but the same results as FIG. 3A and FIG. 3B are obtained when the gloss difference reducing device 10 controls the gloss with the moving velocity of the medium. Further, in the examples in FIG. 3A and FIG. 3B, the gloss difference reducing device 10 performs control to make the gloss of the transparent toner region lower than the gloss of the transparent toner outside region, but even when the gloss difference reducing device 10 appropriately selects the properties of the transparent toner and makes the gloss of the transparent toner region higher than the gloss of the transparent toner outside region, the gloss difference reducing device 10 can reduce the difference between the gloss of the transparent toner outside region and the gloss of the image that is formed without using transparent toner by controlling the fixing temperatures in the same manner as described above such that T1<T0. However, the fixing temperature T2 in the second fixing step has, as mentioned above, as an upper limit the temperature at which the gloss of the region that does not use transparent toner of the image that is formed using transparent toner on part of an image becomes equal to the gloss of the image that is formed without using transparent toner when T1 is used as the lowest fixing temperature of the toner.

Figure 4:
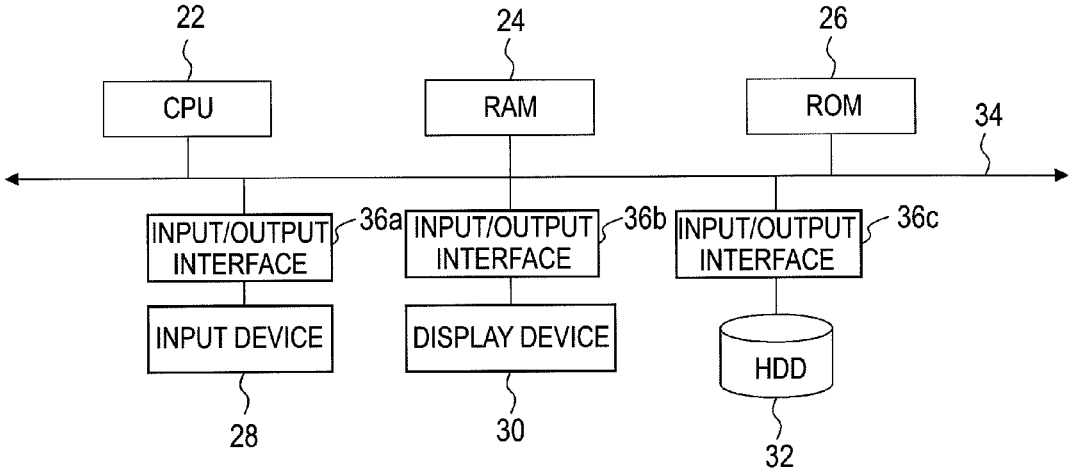
FIG. 4 is a diagram showing an example of the hardware configuration of a computer that configures a gloss difference reducing device.

In FIG. 4, there is shown an example of the hardware configuration of a computer that configures the gloss difference reducing device 10 pertaining to the exemplary embodiment. In FIG. 4, the gloss difference reducing device 10 is configured to include a central processing unit (it is good to use a CPU such as a microprocessor, for example) 22, a random access memory (RAM) 24, a read-only memory (ROM) 26, an input device 28, a display device 30 and a hard disk drive (HDD) 32. Further, these units are connected to each other by a bus 34. It will be noted that the input device 28, the display device 30 and the hard disk drive 32 are respectively connected to the bus 34 via input/output interfaces 36*a*, 36*b* and 36*c*.

The CPU 22 controls the operation of each part described later on the basis of a control program stored in the RAM 24 or the ROM 26. The RAM 24 functions mainly as a work area of the CPU 22, and a control program such as a BIOS and also data that the CPU 22 uses are stored in the ROM 26.

Further, the input device 28 is configured by a keyboard, a pointing device, a touch panel or the like and is used for a user to input operation instructions and the like.

Further, the display device 30 is configured by a liquid crystal display, a touch panel or the like and displays results of processing by the CPU 22 and the like.

Further, the hard disk drive 32 is a storage device and stores various types of data that become necessary for processing described later. It will be noted that a nonvolatile storage device such as an EEPROM may also be used instead of the hard disk drive 32.

Figure 5:
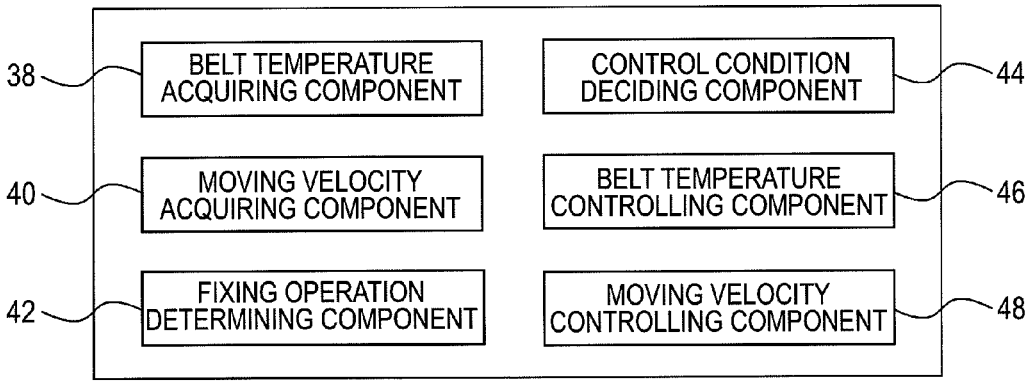
FIG. 5 is a functional block diagram of one exemplary embodiment of the gloss difference reducing device.

In FIG. 5, there is shown a functional block diagram of one exemplary embodiment of the gloss difference reducing device 10 pertaining to the exemplary embodiment. In FIG. 5, the gloss difference reducing device 10 is configured to include a belt temperature acquiring unit 38, a moving velocity acquiring unit 40, a fixing operation determining unit 42, a control condition deciding unit 44, a belt temperature controlling unit 46 and a moving velocity controlling unit 48.

These functions are realized by the CPU 22 and a program that controls the processing operation of the CPU 22, for example.

The belt temperature acquiring unit 38 acquires the temperature of the fixing belt 12*f* that the temperature measuring instrument 12*g* has measured and outputs the temperature to the belt temperature controlling unit 46.

The moving velocity acquiring unit 40 acquires the rotational velocity of the heat roller 12*b* that drives the fixing belt 12*f* to circulate and computes the moving velocity of the medium that moves at a moving velocity equal to that of the fixing belt 12*f*. The moving velocity acquiring unit 40 outputs the computed moving velocity of the medium to the moving velocity controlling unit 48.

The fixing operation determining unit 42 determines whether the fixing operation that the fixing device 12 performs is any of the first fixing step or the second fixing step of the image that is formed using transparent toner on part of an image or the fixing step of the image that is formed without using transparent toner. This determination of the fixing operation is performed on the basis of operation instruction information that a user has inputted from the input device 28, for example.

The control condition deciding unit 44 decides the fixing temperature of the toner or the moving velocity of the medium on the basis of the temperature of the fixing belt 12*f* that the belt temperature acquiring unit 38 has acquired, the moving velocity of the medium that the moving velocity acquiring unit 40 has acquired and the fixing operation that the fixing operation determining unit 42 has determined. The control condition deciding unit 44 may also be configured such that, when the control condition deciding unit 44 performs this decision processing, temperatures of the fixing belt 12*f* or moving velocities of the medium corresponding to each fixing operation are stored beforehand in a storage device such as the hard disk drive 32 and such that the control condition deciding unit 44 reads, as the control condition, the temperature of the fixing belt 12*f* or the moving velocity of the medium on the basis of the determination result of the fixing operation determining unit 42.

The belt temperature controlling unit 46 controls the temperatures of the heat rollers 12*a*, 12*b* and 12*c* so as to make the temperature of the fixing belt 12*f* the temperature that the control condition deciding unit 44 has decided as the control condition.

The moving velocity controlling unit 48 controls the rotating velocity of the heat roller 12*b* so as to make the moving velocity of the medium the velocity that the control condition deciding unit 44 has decided as the control condition.

Figure 6:
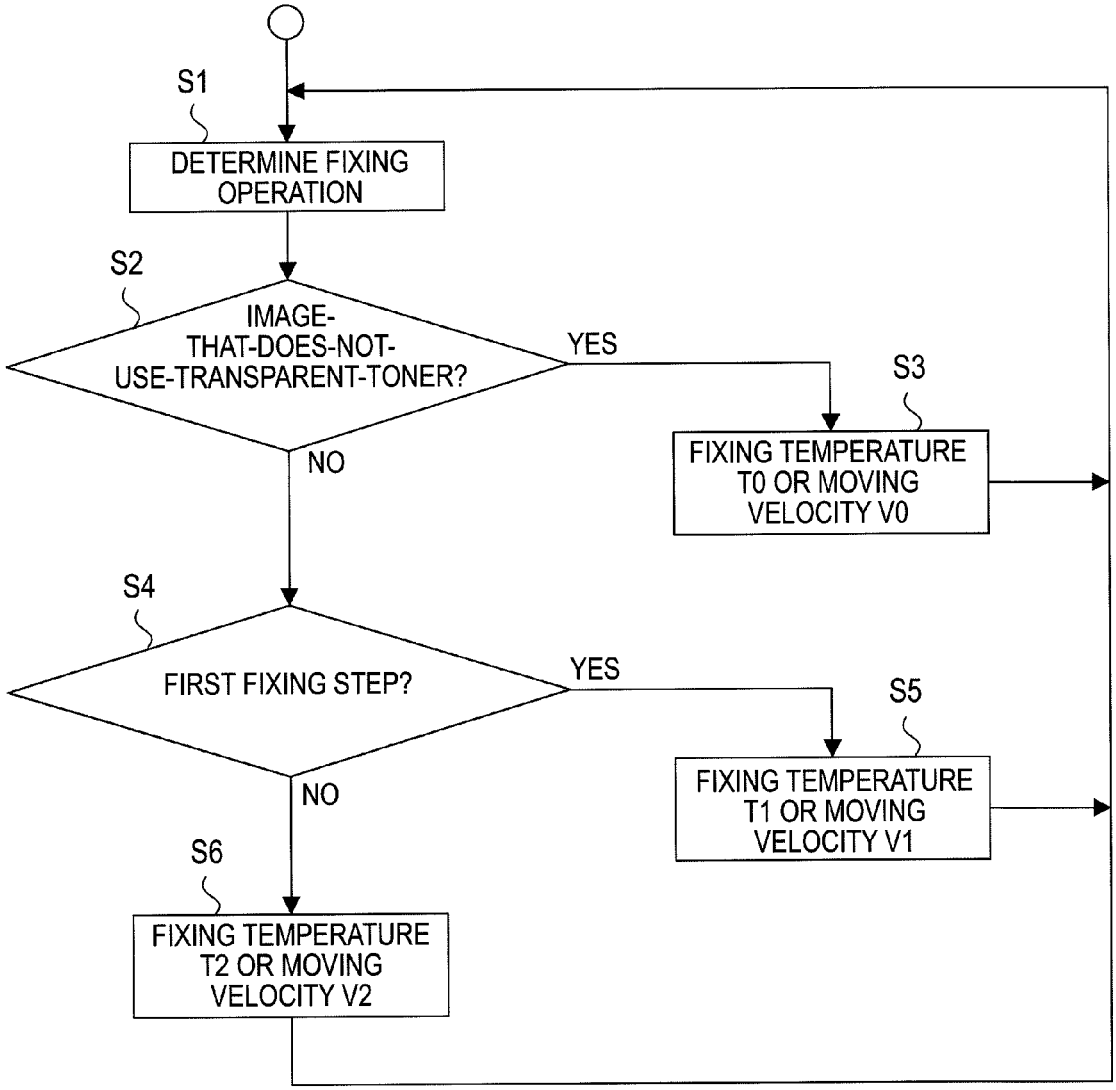
FIG. 6 is a flowchart of an operational example of the gloss difference reducing device.

In FIG. 6, there is shown a flow of an operational example of the gloss difference reducing device 10 pertaining to the exemplary embodiment. In FIG. 6, the fixing operation determining unit 42 of the gloss difference reducing device 10 determines the content of the fixing operation of the toner image that has been transferred onto the medium that has been received from the developing/transferring device 16 (S1). When, as a result of this determination, the fixing operation is fixing of the image that is formed without using transparent toner (S2), the control condition deciding unit 44 decides, as the condition of the fixing operation, the fixing temperature T0 for fixing in one fixing operation the image that is formed without using transparent toner or the moving velocity V0 of the medium (S3).

Further, in S2, when the determination result is not fixing of the image that is formed without using transparent toner, the fixing operation determining unit 42 determines whether or not the fixing operation is the first fixing step of the image that is formed using transparent toner on part of an image (S4). When the fixing operation is the first fixing step, the control condition deciding unit 44 decides, as the condition of the fixing operation, the fixing temperature T1 in the first fixing step or the moving velocity V1 (S5). It will be noted that, as mentioned above, T1<T0 and V1>V0. Further, as for T1 or V1, the control condition deciding unit 44 first decides the fixing temperature T2 in the second fixing step for making the gloss of the transparent toner region in the image that is formed using transparent toner on part of an image into a target value or the moving velocity V2 and decides T1 or V1 such that it can reduce the difference between the gloss of the transparent toner outside region and the gloss of the image that is formed without using transparent toner in consideration of the amount of heat that is applied to the medium by T2 or V2.

Further, in S4, when the determination result is not the first fixing step, the fixing operation determining unit 42 determines that the fixing operation is the second fixing step of the image that is formed using transparent toner on part of an image. As a result, the control condition deciding unit 44 decides, as the condition of the fixing operation, the fixing temperature T2 in the second fixing step or the moving velocity V2 (S6).

As described above, when the control condition deciding unit 44 decides the condition of the fixing operation, the belt temperature controlling unit 46 controls, on the basis of the determined fixing temperature, the temperature of the fixing belt 12*f* that the belt temperature acquiring unit 38 acquires, and the moving velocity controlling unit 48 controls, on the basis of the determined moving velocity, the moving velocity of the medium that the moving velocity acquiring unit 40 has computed.

It will be noted that the program for executing each of the steps in FIG. 6 can also be stored in a recording medium, or that program may be provided by a communication unit. In that case, for example, the described program may be grasped as an invention of "a computer readable recording medium in which is recorded a program".

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a gloss difference reducing unit that reduces a difference between gloss of a first image that is formed on a medium in a first mode and gloss of a region of a second image that is formed on the medium in a second mode, wherein the first mode is configured such that the first image is formed onto the medium in one fixing operation, without using transparent toner, wherein the second mode is configured such that the second image is formed by implementing a first fixing step and a second fixing step after the first fixing step, wherein the region of the second image is formed without using transparent toner, wherein part of the second image is formed using transparent toner, wherein the first fixing step fixes an intermediate image on the medium, wherein the intermediate image is formed by toner other than transparent toner, and wherein the second fixing step fixes transparent toner to a part of the intermediate image.

2. The image forming apparatus according to claim 1, wherein the one fixing operation is performed at a fixing temperature $T_0$, wherein the first fixing step fixes the intermediate image at a fixing temperature $T_1$, and wherein the gloss difference reducing unit sets $T_1$ to be lower than $T_0$.

3. The image forming apparatus according to claim 1, wherein the first fixing step fixes the intermediate image at a fixing temperature $T_1$, wherein the second fixing step fixes transparent toner to the part of the intermediate image at a fixing temperature $T_2$, and wherein the gloss difference reducing unit is configured to set an upper limit of $T_2$ to be the temperature at which the gloss of the region of the second image, after the second fixing step, becomes equal to the gloss of the first image when $T_1$ is used as the lowest fixing temperature of the toner.

4. The image forming apparatus according to claim 2, wherein the second fixing step fixes transparent toner to the part of the intermediate image at a fixing temperature $T_2$, and wherein the gloss difference reducing unit is configured to set an upper limit of $T_2$ to be the temperature at which the gloss of the region of the second image, after the second fixing step, becomes equal to the gloss of the first image when $T_1$ is used as the lowest fixing temperature of the toner.

5. The image forming apparatus according to claim 1, wherein the one fixing operation is performed at a moving velocity $V_0$, wherein the first fixing step fixes the intermediate image at a moving velocity $V_1$, and wherein the gloss difference reducing unit sets $V_1$ to be faster than $V_0$.

6. An image forming method, comprising:

reducing a difference between gloss of a first image formed on a medium and gloss of a region of a second image formed on the medium by performing operations comprising:

in a first mode, forming the first image on the medium in one fixing operation without using transparent toner;

in a second mode, forming the second image by implementing a first fixing step and a second fixing step after the first fixing step, wherein the region of the second image is formed without using transparent toner, wherein part of the second image is formed using transparent toner, wherein the first fixing step comprises fixing an intermediate image on the medium;

wherein the intermediate image is formed by toner other than transparent toner, and wherein the second fixing step comprises fixing transparent toner to a part of the intermediate image.

7. The image forming method according to claim 6, wherein the one fixing operation is performed at a fixing temperature $T_0$, wherein the first fixing step fixes the intermediate image at a fixing temperature $T_1$, and wherein the image forming method further comprises setting $T_1$ to be lower than $T_0$.

8. The image forming method according to claim 6, wherein the first fixing step fixes the intermediate image at a fixing temperature $T_1$, wherein the second fixing step fixes transparent toner to the part of the intermediate image at a fixing temperature $T_2$, and wherein the image forming method further comprises setting an upper limit of $T_2$ to be the temperature at which the gloss of the region of the second image, after the second fixing step, becomes equal to the gloss of the first image when $T_1$ is used as the lowest fixing temperature of the toner.

9. The image forming method according to claim 7, wherein the second fixing step fixes transparent toner to the part of the intermediate image at a fixing temperature $T_2$, and wherein the image forming method further comprises setting an upper limit of $T_2$ to be the temperature at which the gloss of the region of the second image, after the second fixing step, becomes equal to the gloss of the first image when $T_1$ is used as the lowest fixing temperature of the toner.

10. The image forming method according to claim 6, wherein the one fixing operation is performed at a moving velocity $V_0$, wherein the first fixing step fixes the intermediate image at a moving velocity $V_1$, and wherein the image forming method further comprises setting $V_1$ to be faster than $V_0$.

11. A computer readable medium storing a program causing a computer to execute a process for forming an image, the process comprising:

reducing a difference between gloss of a first image formed on a medium and gloss of a region of a second image formed on the medium by performing operations comprising:

in a first mode, forming the first image on the medium in one fixing operation without using transparent toner;

in a second mode, forming the second image by implementing a first fixing step and a second fixing step after the first fixing step, wherein the region of the second image is formed without using transparent toner, wherein part of the second image is formed using transparent toner, wherein the first fixing step comprises fixing an intermediate image on the medium;

wherein the intermediate image is formed by toner other than transparent toner, and wherein the second fixing step comprises fixing transparent toner to a part of the intermediate image.

12. The computer readable medium according to claim 11, wherein the one fixing operation is performed at a fixing temperature $T_0$, wherein the first fixing step fixes the intermediate image at a fixing temperature $T_1$, and wherein the operations further comprise setting $T_1$ to be lower than $T_0$.

13. The computer readable medium according to claim 11, wherein the first fixing step fixes the intermediate image at a fixing temperature $T_1$, wherein the second fixing step fixes transparent toner to the part of the intermediate image at a fixing temperature $T_2$, and wherein the operations further comprise setting an upper limit of $T_2$ to be the temperature at which the gloss of the region of the second image, after the second fixing step, becomes equal to the gloss of the first image when $T_1$ is used as the lowest fixing temperature of the toner.

14. The computer readable medium according to claim 12, wherein the second fixing step fixes transparent toner to the part of the intermediate image at a fixing temperature $T_2$, and wherein the operations further comprise setting an upper limit of $T_2$ to be the temperature at which the gloss of the region of the second image, after the second fixing step, becomes equal to the gloss of the first image when $T_1$ is used as the lowest fixing temperature of the toner.

15. The computer readable medium according to claim 11, wherein the one fixing operation is performed at a moving velocity $V_0$, wherein the first fixing step fixes the intermediate image at a moving velocity $V_1$, and wherein the operations further comprise setting $V_1$ to be faster than $V_0$.

16. The image forming apparatus according to claim 1, wherein the gloss difference reducing unit is configured to reduce the difference between gloss of the first image and gloss of the region of the second image such that gloss of the first image and gloss of the region of the second image becomes substantially identical.

* * * * *